US009802112B2

(12) United States Patent
Shigeta

(10) Patent No.: US 9,802,112 B2
(45) **Date of Patent: *Oct. 31, 2017**

(54) TABLE GAME SYSTEM

(71) Applicant: Angel Playing Cards Co., Ltd., Osaka (JP)

(72) Inventor: Yasushi Shigeta, Kyoto (JP)

(73) Assignee: Angel Playing Cards Co., Ltd., Shiga (JP)

( * ) Notice: Subject to any disclaimer, the term of this patent is extended or adjusted under 35 U.S.C. 154(b) by 11 days.

This patent is subject to a terminal disclaimer.

(21) Appl. No.: 14/441,488

(22) PCT Filed: Jul. 8, 2013

(86) PCT No.: PCT/JP2013/004207

§ 371 (c)(1),
(2) Date: May 7, 2015

(87) PCT Pub. No.: WO2014/073135

PCT Pub. Date: May 15, 2014

(65) Prior Publication Data

US 2015/0290527 A1 Oct. 15, 2015

(30) Foreign Application Priority Data

Nov. 8, 2012 (JP) ..... 2012-259097

(51) Int. Cl.
*A63F 1/12* (2006.01)
*A63F 1/02* (2006.01)
(Continued)

(52) U.S. Cl.
CPC ..... *A63F 1/02* (2013.01); *A63F 1/10* (2013.01); *A63F 1/12* (2013.01); *A63F 1/14* (2013.01);
(Continued)

(58) Field of Classification Search
CPC ..... A63F 1/12; A63F 1/14
(Continued)

(56) References Cited

U.S. PATENT DOCUMENTS 4,821,109 A * 4/1989 Roe ..... H04N 1/4055 358/3.24
5,722,893 A * 3/1998 Hill ..... A63F 1/14 273/149 R
(Continued)

FOREIGN PATENT DOCUMENTS

CN 1638842 A 7/2005
CN 101310803 A 11/2008
(Continued)

OTHER PUBLICATIONS

Chinese Patent Application No. 2013102136321, First Office Action dated Feb. 3, 2016.
(Continued)

*Primary Examiner* — Aarti B Berdichevsky
*Assistant Examiner* — Dolores Collins
(74) *Attorney, Agent, or Firm* — Norton Rose Fulbright US LLP

(57) ABSTRACT

A table game system is provided that includes a plurality of association tables, each of which makes it possible to obtain the correlation between codes attached to shuffled playing cards and the ranks thereof, and prevents the correlation between the codes of the shuffled playing cards and the ranks thereof from being known by a person who intends to commit cheating by changing the association table used as appropriate.

A card shoe apparatus 2 of the table game system of the present invention includes a barcode reader 100 that reads a barcode 3 attached to a shuffled playing card set 1*s*, and thereby reads a shuffled card ID that can uniquely identify
(Continued)

the shuffled playing card set 1*s*. The shuffled card ID of the shuffled playing cards to be used is subjected to a process of association to identify one of association table numbers (T1 to T10) or database numbers, and the rank and the suit of a card 1 that are attached to the card 1 are identified based on a code C with an association table (T3). If the code C does not match a code defined in the association table (T3), an error occurs and it is determined that cheating may be committed.

6 Claims, 6 Drawing Sheets

(51) Int. Cl.

| | |
|---|---|
| ***A63F 1/14*** | (2006.01) |
| ***A63F 1/18*** | (2006.01) |
| ***G07F 17/32*** | (2006.01) |
| ***A63F 1/10*** | (2006.01) |
| *A63F 9/24* | (2006.01) |
| *A63F 1/00* | (2006.01) |

(52) U.S. Cl.
CPC ..... *A63F 1/18* (2013.01); *G07F 17/322* (2013.01); *G07F 17/3241* (2013.01); *A63F 2001/001* (2013.01); *A63F 2009/242* (2013.01); *A63F 2009/2439* (2013.01)

(58) Field of Classification Search
USPC ..... 273/149 R
See application file for complete search history.

(56) References Cited

U.S. PATENT DOCUMENTS

| | | | | | |
|---|---|---|---|---|---|
| 5,989,122 | A * | 11/1999 | Roblejo | A63F 1/14 | 273/149 P |
| 6,422,464 | B1 * | 7/2002 | Terranova | B67D 7/067 | 235/380 |
| 6,726,205 | B1 * | 4/2004 | Purton | A63F 1/14 | 273/148 R |
| 7,029,009 | B2 * | 4/2006 | Grauzer | A63F 1/14 | 273/149 P |
| 7,374,170 | B2 * | 5/2008 | Grauzer | A63F 1/14 | 273/149 R |
| 7,717,427 | B2 * | 5/2010 | Grauzer | A63F 1/14 | 273/149 P |
| 7,764,836 | B2 * | 7/2010 | Downs, III | A63F 1/12 | 273/149 R |
| 8,221,244 | B2 * | 7/2012 | French | G07F 17/32 | 463/11 |
| 8,337,296 | B2 * | 12/2012 | Grauzer | A63F 1/18 | 273/292 |
| 8,408,550 | B2 * | 4/2013 | Walker | A63F 1/14 | 273/149 R |
| 8,919,777 | B2 * | 12/2014 | Shigeta | A63F 1/12 | 273/293 |
| 8,998,210 | B2 * | 4/2015 | Shigeta | A63F 1/14 | 273/148 R |
| 9,403,082 | B2 * | 8/2016 | Shigeta | A63F 1/06 | |
| 2002/0017481 | A1 * | 2/2002 | Johnson | A63F 1/12 | 209/547 |
| 2003/0176209 | A1 | 9/2003 | Soltys et al. | | |
| 2004/0026636 | A1 | 2/2004 | Shigeta | | |
| 2005/0082750 | A1 * | 4/2005 | Grauzer | G07F 17/3293 | 273/149 R |
| 2005/0113166 | A1 * | 5/2005 | Grauzer | A63F 1/14 | 463/29 |
| 2006/0063577 | A1 | 3/2006 | Downs | | |
| 2008/0143048 | A1 | 6/2008 | Shigeta | | |
| 2010/0133754 | A1 | 6/2010 | Shigeta | | |
| 2010/0327525 | A1 | 12/2010 | Shigeta | | |
| 2012/0018951 | A1 | 1/2012 | Just | | |
| 2015/0196835 | A1 * | 7/2015 | Shigeta | A63F 1/14 | 273/148 A |

FOREIGN PATENT DOCUMENTS

| | | | |
|---|---|---|---|
| CN | 101854982 | A | 10/2010 |
| EP | 1316341 | A1 | 6/2003 |
| EP | 2228106 | A1 | 2/2012 |
| JP | 2008029865 | A | 2/2008 |
| JP | 4885103 | B2 | 2/2012 |
| KR | 1020070030151 | | 3/2007 |
| WO | 2009069708 | A1 | 6/2009 |
| WO | 2014064868 | A1 | 5/2014 |

OTHER PUBLICATIONS

New Zealand Patent Application No. 707424, First Examination Report dated Feb. 15, 2016.
Australian Patent Application No. 2013203305, Patent Examination Report No. 1 dated Sep. 10, 2014.
International Application No. PCT/JP2013/004207, International Search Report dated Oct. 4, 2013.
Korean Office Action, Korean Patent Application No. 10-2015-7012011, dated Oct. 13, 2016.

* cited by examiner

| Combination | Arrangement of marking | Outputs of sensors |
|---|---|---|
| 1 | Blank<br>Blank | OFF<br>OFF |
| 2 | Blank<br>M | OFF<br>ON OFF |
| 3 | M<br>Blank | ON OFF<br>OFF |
| 4 | M<br>M | ON OFF<br>ON OFF |

FIG. 6

TABLE GAME SYSTEM

CROSS REFERENCE TO RELATED APPLICATIONS

This application is a National Phase application under 35 U.S.C. §371 of PCT Application PCT/JP2013/004207, filed Jul. 8, 2013, which application claims priority benefit to Japanese Application Serial No. 2012-259097, filed Nov. 8, 2012, which applications are hereby incorporated by reference.

TECHNICAL FIELD

The present invention relates to a table game system with a security function in a card game such as baccarat using playing cards (hereinafter simply referred to as "cards").

BACKGROUND ART

In poker, baccarat, bridge, blackjack, and other card games, a dealer sets one or more decks of playing cards in a card shoe or the like, and deals cards to game players by drawing them therefrom one by one. In so doing, to ensure the fairness of the games, the cards need to be dealt at random. Therefore, a game host must sufficiently shuffle the playing cards randomly to ensure a random order of arrangement of the playing cards before they are set in the card shoe. The shuffled playing cards used in various card games such as poker, baccarat, bridge or blackjack will ordinarily include 416 cards if eight decks of cards are used.

A conventional card shuffling device for shuffling cards is disclosed in, for example, Patent Literature 1. Each shuffled playing card set is provided after being shuffled with a shuffling apparatus to be arranged in a unique order with a uniquely identifiable shuffled card ID affixed on its packing box or the like as a barcode.

Also, a technique for printing on each card used in a casino or the like the suit (type) and the rank (or number) of the card as a code in order to prevent counterfeiting is disclosed in Patent Literature 2 or the like.

Shuffled playing cards are dealt from a card shoe apparatus to be used in a game, and the code of each card dealt that represents its rank is read by the card shoe apparatus. In recent years, technology for counterfeiting cards has greatly advanced, and accordingly, illegal counterfeiting of cards with such code attached is no longer impossible. In a case where card itself is not falsified, a card which has regular code (qualified code) is illegally obtained. In such a case, before using the card for the game, this card can be mixed into a predetermined position among the shuffled playing cards. Further, in such a case, the falsified shuffled playing cards which is intentionally ordered can be wholly replaced for regular cards (8 decks of cards).

PATENT LITERATURE

[PTL 1] WO 2009/069708
[PTL 2] JP4885103B

SUMMARY OF INVENTION

Technical Problem

The present invention has been made in view of the above problem, and aims to provide a table game system that includes a plurality of association tables or a plurality of databases, each of which makes it possible to obtain the correlation between the code attached to each of shuffled playing cards and the rank of the card. By changing the association table or the database to be used as appropriate so that the correlation between the code and the rank in the shuffled playing cards can be obtained only from the shuffled card ID which is attached on each of shuffled playing cards.

According to the present invention, when the card having falsified code is set into the regular shuffled playing cards, this falsified card (the card fraudulently set into the regular shuffled playing cards) can be found based on that the correlation between the code of the regular playing cards and the rank. (The code of this falsified card does not match with the correlation between the code of the regular playing cards and the rank).

Further, according to the present invention, the correlation between the code of each card and the rank of each card is different among each shuffled playing cards. The correlation between the code group and the rank of each shuffled playing cards can be obtained only from the shuffled card ID which is attached on each of shuffled playing cards and is identifiable individually. Even when the falsified shuffled playing cards which is intentionally ordered can be wholly replaced for regular cards (8 decks of cards), the correlation between the code of the cards and the rank obtained from the shuffled card ID does not match with the correlation between the code of the falsified shuffled playing cards and the rank. Thus, the present invention has a countermeasure to prevent cheating by changing the association table or the database to be used as appropriate so that the correlation between the codes and the ranks of the cards cannot be known to a person who intends to commit cheating.

Solution to Problem

To solve the above conventional problems, the present invention provides a table game system including:

- shuffled playing cards composed of playing cards made up of a plurality of number of decks shuffled to have a unique arrangement order, a uniquely identifiable shuffled card ID being attached to the shuffled playing cards as an ID code; and
- a card shoe apparatus that includes a barcode reader capable of identifying the shuffled card ID, and houses the shuffled playing cards such that the said shuffled playing cards can be manually dealt one by one onto a game table, wherein each card of the shuffled playing cards is given a code concerning a rank of the card, the card shoe apparatus includes:

- a card housing unit for housing the shuffled playing cards;
- an opening for drawing cards from the card housing unit one by one;
- a card reading unit that reads from the card the code attached to the card concerning the rank thereof; and
- a control unit that stores rules of a card game and includes a winner/loser determination unit that determines the winner/loser of the card game based on the information on the ranks of the cards read by the card reading unit, the control unit includes a memory for storing a plurality of association tables or a plurality of databases, each of which makes it possible to obtain the rank of each card based on the code of each card of the shuffled playing cards, and each association table or database is recorded in association with the shuffled card ID, and one of the plurality of association tables or databases is identified by identifying the shuffled card ID with the barcode reader, and based on the association table or database identified, the card reading unit reads the code when each card is drawn from the card housing unit and the rank of the card is identified based on that code.

Advantageous Effects of Invention

With the present invention, it is possible to provide a table game system in which a card shoe apparatus includes a plurality of association tables or a plurality of databases each of which makes it possible to obtain the correlation between the codes attached to the cards of the shuffled playing cards and the ranks thereof, and which has a countermeasure to prevent cheating in which a shuffled card ID of the shuffled playing cards to be used is read to identify such shuffled playing cards, and a set of codes attached to such shuffled playing cards to be used is identified based on the shuffled card ID, thereby automatically identifying within the card shoe apparatus one of the association tables or databases, each of which makes it possible to obtain the correlation between the codes and the ranks, so that a person who intends to commit cheating is prevented from knowing the correlation between the codes and the ranks of the cards.

BRIEF DESCRIPTION OF DRAWINGS

FIG. 6 is a diagram showing the relation between the output waves from sensors and marks in the card shoe apparatus.

DESCRIPTION OF EMBODIMENTS

Figure 1:
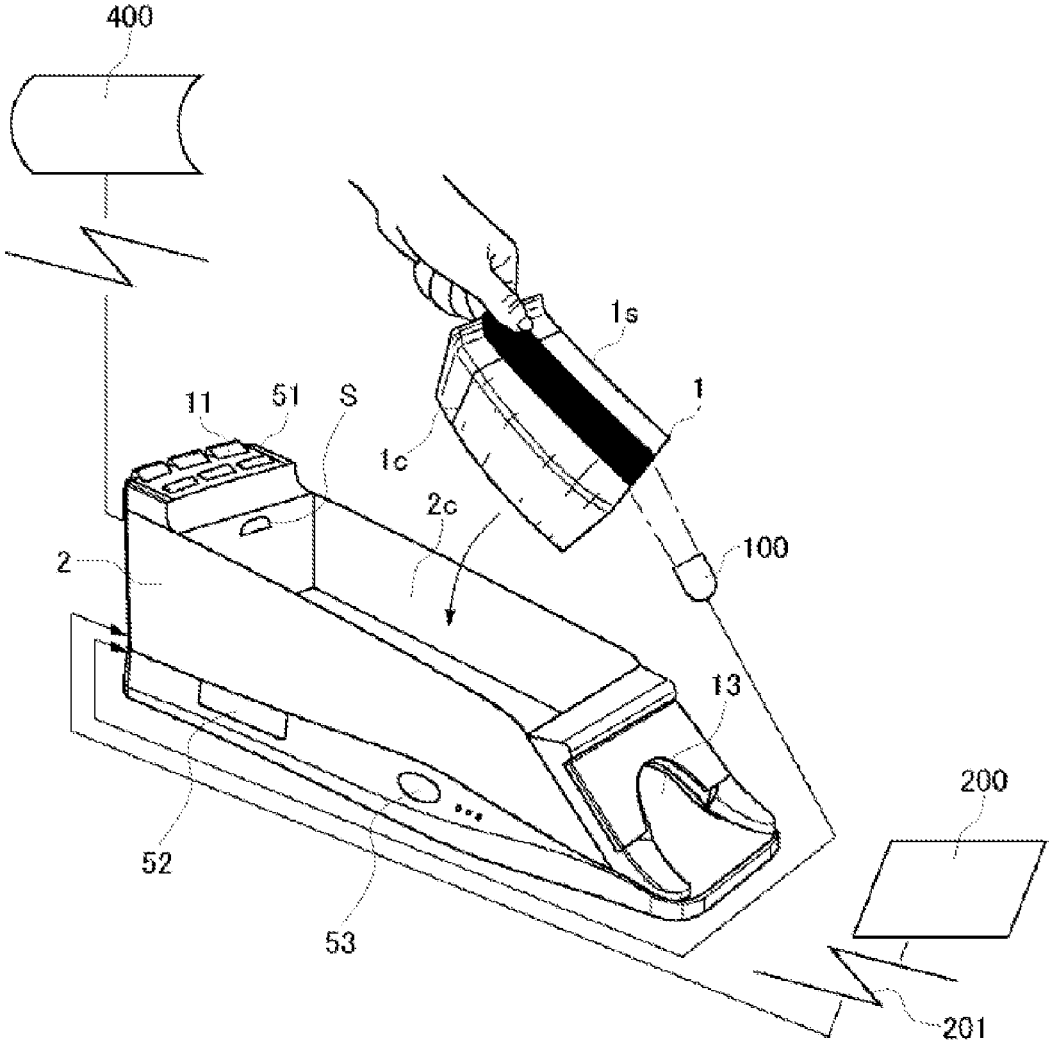
FIG. 1 is a perspective view schematically showing the entirety of a table game system according to an embodiment of the present invention.
Figure 2:
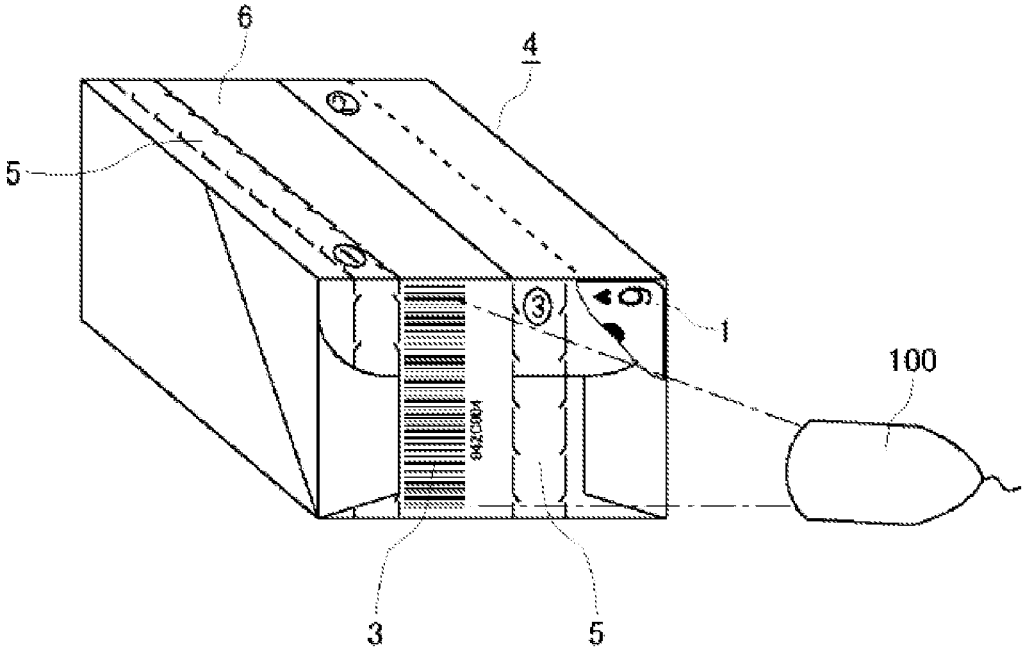
FIG. 2 is a perspective view of shuffled playing cards to be used in the table game system according to the embodiment of the present invention.

An embodiment of a table game system of the present invention will be described below. FIG. 1 is a perspective view schematically showing the entirety of a table game system according to an embodiment of the present invention. FIG. 2 is a perspective view of shuffled playing cards to be used in the table game system according to the embodiment of the present invention. Although a shuffled playing card set 1*s* is packed in the table game system of the present embodiment, when the shuffled playing card set 1*s* is to be used in the game, it is housed in a card shoe apparatus 2 after the packing is undone to enable the cards 1 of the shuffled playing card set 1*s* to be dealt one by one. During the game, the dealer deals the cards 1 from the card shoe apparatus 2 onto the game table. The cards 1 of each shuffled playing card set 1*s*, which is made up of a predetermined number of decks (normally, 6, 8, 9 or 10 decks), are shuffled to be arranged in a unique and random arrangement order, and packed with a uniquely identifiable shuffled card ID attached to a packing box 4 as a barcode 3 or (RFID or RF-tag can be used instead) as an ID code.

In an assembled state, the packing box 4 of the shuffled playing card set 1*s* has the shape of a rectangular parallelepiped, encasing the shuffled playing card set 1*s* as shown in FIG. 2. The packing box 4 has zippers 5 provided in two locations at a predetermined interval, each of which has zipper-shaped cut lines arranged in parallel to a longitudinal direction of the rectangular parallelepiped shape, and has a central band 6 in the central portion defined by the zippers 5 provided in the two locations. The central band 6 is colored so as to be readily distinguishable from the other portions (the central band 6 is not colored in FIG. 2). A configuration is achieved in which by removing the two zippers 5 along the cut lines, the left and right side faces of the packing box 4 are removed such that the side faces of the shuffled playing card set 1*s* would be exposed (FIG. 1). Circled numbers 1 to 3 indicating the procedural order for removing the zippers 5 are printed on each of the zippers 5, as shown in FIG. 2.

A cut card 1*c* is inserted in the shuffled playing card set 1*s* before it is set in the card shoe apparatus 2. The cut card 1*c* is inserted at any place within the latter half portion of the shuffled playing card set 1*s* when used in a game (in the last quarter or one-fifth of the shuffled playing card set 1*s*). The cut card 1*c* is used to end a game at the game table leaving about 20 to 40 cards 1 in the card shoe apparatus 2 to prevent any player or anyone from counting the ranks of the cards 1 dealt during a game to predict the ranks of the cards when the number of cards not yet dealt becomes small. Normally, when the cut card 1*s* is drawn during a game, use of the shuffled playing card set 1*s* currently in use is stopped after that game or a few games thereafter, and the game ends. The shuffled playing card set 1*s* in the card shoe apparatus 2 is replaced with a new set, and a new game begins.

In FIG. 1, the table game system of the present embodiment includes the shuffled playing card set 1*s* composed of cards 1 made up of a predetermined number of decks shuffled to have a unique arrangement order, and which has a uniquely identifiable shuffled card ID attached as the barcode 3, and the card shoe apparatus 2 for housing the shuffled playing card set 1*s* therein to allow the manual dealing of the housed cards 1 one by one onto the game table, and which has a barcode reader 100 or an input means 200 capable of identifying the shuffled card ID.

Figure 3:
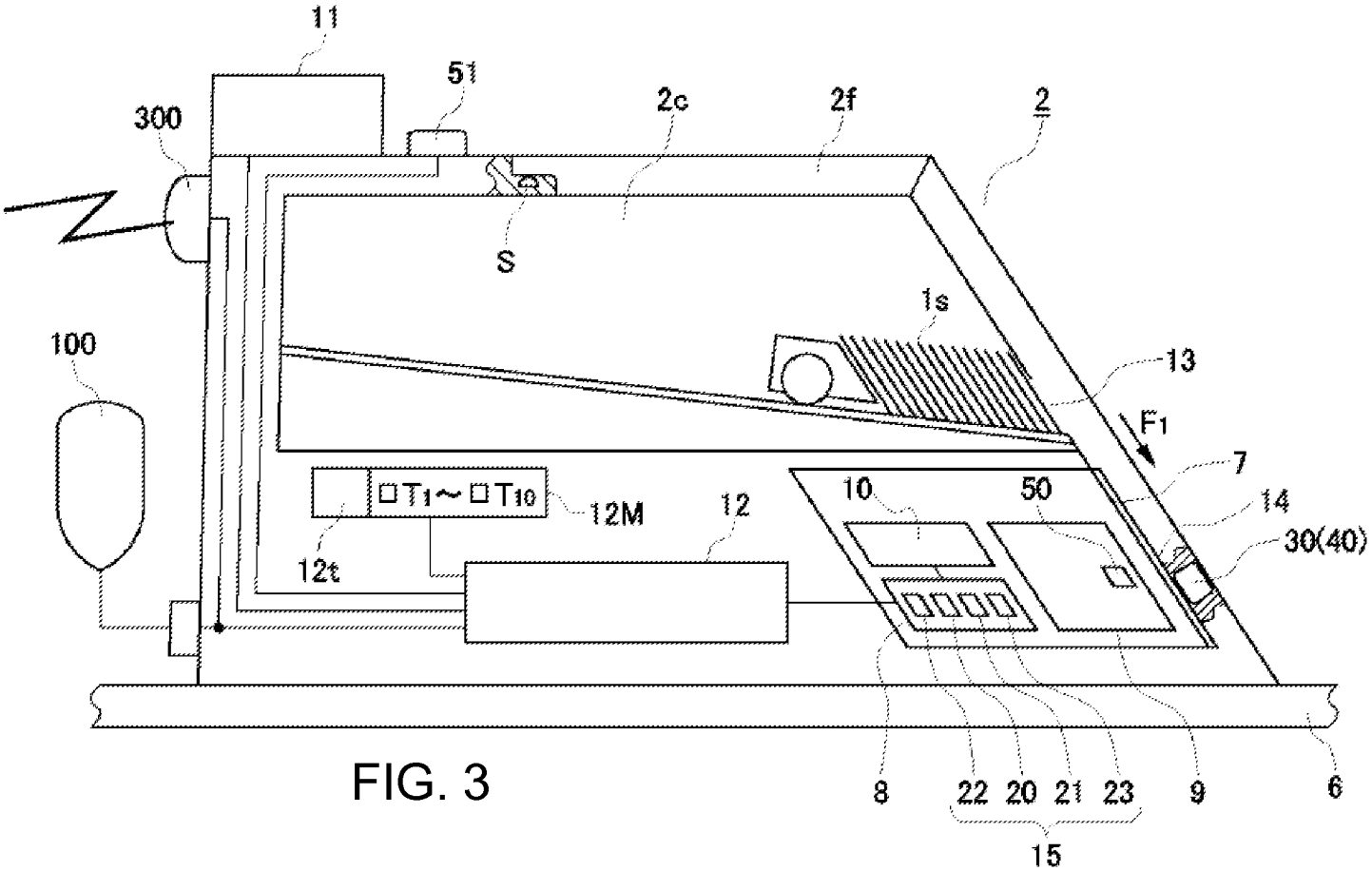
FIG. 3 is a diagram showing a general configuration of the card shoe apparatus.

In FIG. 3, the card shoe apparatus 2 of the table game system of the present embodiment is provided with a lid 2*f* that enables the insertion and removal of the shuffled playing card set 1*s*. A sensor S for detecting the opening/closing of the lid 2*f* is provided under the lid 2*f*, and which detects the opening/closing of the lid 2*f*, thereby detecting the replacement of the shuffled playing card set 1*s*. The card shoe apparatus 2 has a card guide unit 7 that guides cards 1 that are manually drawn one by one from a card housing unit 2C onto a game table, a code reading unit 8 that reads, when a card 1 is manually drawn from the card housing unit 2C by a dealer or the like of a casino, a code C that indicates a figure (number, rank) of that card 1, a winner/loser determination unit 10 that determines the winner/loser of the card game based on the numbers (ranks) of the cards 1 sequentially read by the code reading unit 8, and an output means 11 that outputs the result of the determination made by the winner/loser determination unit 10.

Figure 4:
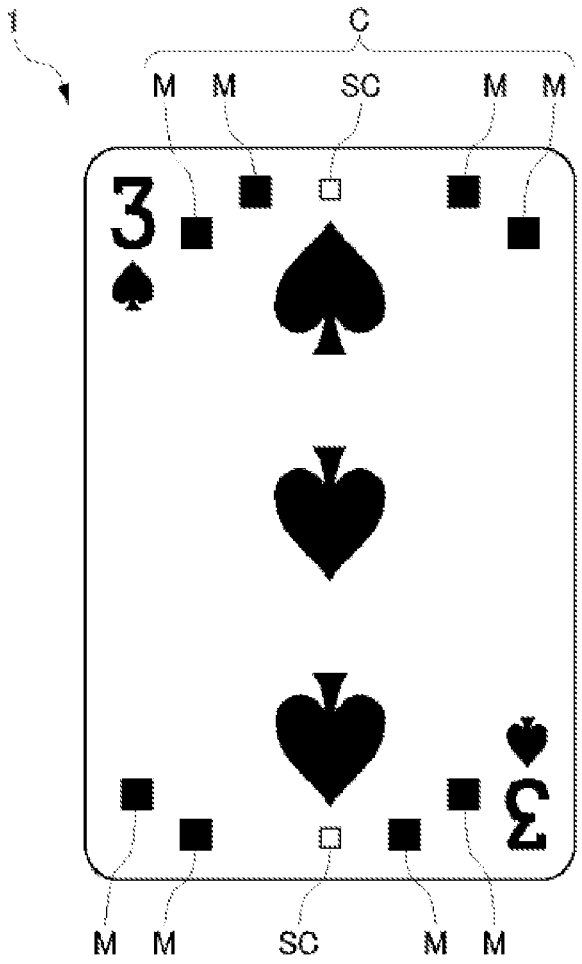
FIG. 4 is a plan view of a card according to the embodiment of the present invention.

FIG. 4 shows a card 1 of the shuffled playing card set 1*s*. A figure is encoded and printed on each card 1 that is used in a table game such as baccarat as a mark M in UV ink or the like, which is invisible under normal conditions. Codes C, each of which is configured with marks M, are provided in the upper and lower sides of the card 1 in a point-symmetric manner. Also, each card 1 of the playing card set 1*s* has printed thereon a group code SC. The shuffled card ID identified by the barcode 3 (as the ID code) is stored in the database in association with the group code SC. The group codes SC are also provided in the upper and lower sides of the card 1 in a point-symmetric manner. Preferably, the code C and the group code SC are printed in positions where they do not overlap with the indications of the card types or indexes with a paint material that becomes visible when irradiated with a UV ray.

Figure 5:
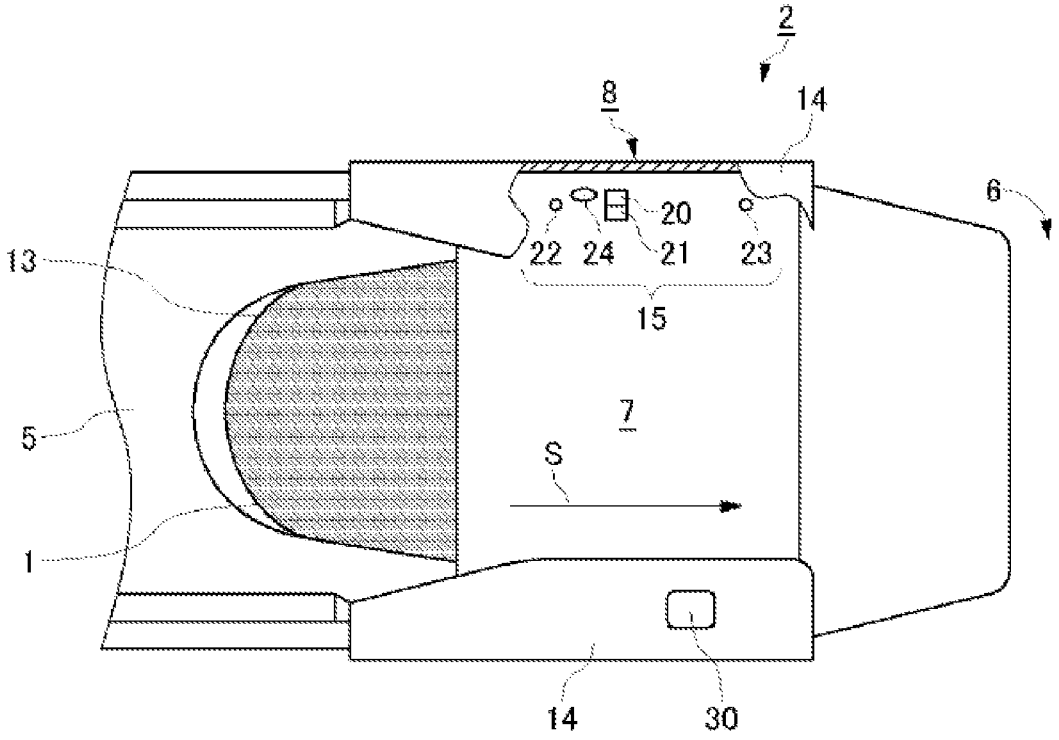
FIG. 5 is an enlarged plan view showing a main portion of a card guide of the card shoe apparatus, in which the card guide is partially broken.

Next, the code reading unit 8, which reads from a card 1 the code C that indicates the figure (number, rank) of the card 1 when the card 1 is manually drawn from the card housing unit 2C, will be described in detail with reference to FIG. 5. FIG. 5 is a plan view of a main portion of the card shoe apparatus 2. In FIG. 5, the code reading unit 8 is provided in the card guide unit 7 that guides the cards 1 manually drawn one by one from an opening 13 of the card housing unit 2C onto the game table, with the opening 13 provided in a front portion of the card housing unit 2C. The card guide unit 7 is inclined, and a card guide cover 14 is attached to a portion of the edge of each of both sides thereof, with the card guide cover 14 also serving as a sensor cover. Also, each of the two card guide covers 14 is configured to be attachable/detachable with screws or the like (not shown). When a card guide cover 14 is removed, a sensor group 15 of the code reading portion 8 is exposed. The sensor group 15 is composed of five sensors, including two ultraviolet reactive sensors (UV sensors) 20 and 21, and object detection sensors 22 and 23. Note that a UV sensor 24 for reading the group code SC is provided near the two UV sensors 20 and 21. The UV sensor 24 has the same function as that of the UV sensors 20 and 21, and outputs a signal depending on the presence of the group code SC.

The object detection sensors 22 and 23 are optical fiber sensors that each can detect the presence of a card 1 and movement thereof. The object detection sensor 22 is placed in the upstream side of the card guide unit 7 in the direction of the flow (arrow F) of the card 1, and the object detection sensor 23 is placed in the downstream side of the card guide unit 7 in the direction of the flow of the card 1. As shown in FIG. 5, the object detection sensors 22 and 23 are provided in the upstream and downstream sides of the UV sensors 20 and 21, respectively. Each of the UV sensors 20 and 21 includes an LED (UV LED) that emits an ultraviolet ray and a detector. The marks M are printed on the card 1 in UV luminescent ink that emits color when UV ray is applied. The card 1 is irradiated with the UV ray (black light), and the detector detects the light reflected by the marks M of the code C of the card 1. The UV sensors 20 and 21 are connected to a control unit 12 of the code reading unit 8 via a cable. In the code reading unit 8, the arrangement patterns of the marks M are determined based on the output signals of the detectors of the UV sensors 20 and 21, and the number (rank) corresponding to the code C is also determined.

In the code reading unit 8, the start and end of the reading performed by the UV sensors 20 and 21 are controlled by the control unit 12 based on the detection signals from the object detection sensors 22 and 23. Also, the control unit 12 determines whether a card 1 has properly passed through the card guide unit 7 based on the detection signals from the object detection sensors 22 and 23. As shown in FIG. 4, the rectangular marks M are arranged within a framework of two rows with four columns on each of the upper and bottom edges of the card 1, and the arrangement of such marks M indicates the rank (number) and the suit (Heart, Spade or the like) of the card 1. If the UV sensor(s) 20 and/or 21 detect(s) a mark M, such UV sensor(s) will give out an on signal. The code reading unit 8 determines the relative relation between the signals received from the two UV sensors 20 and 21. This enables the code reading unit 8 to identify the code based on the relative difference or the like between the two marks M detected by the two UV sensors 20 and 21, thereby identifying the number (rank) and the type (suit) of the corresponding card 1.

The relation between the code C and the output of the on signals of the two UV sensors 20 and 21 are shown in FIG. 6. It is possible to identify a predetermined arrangement pattern of the marks M based on the results of a comparison of the relative changes in the output of the on signals of the UV sensors 20 and 21. As a result, in two rows (the upper and lower rows), four types of arrangement patterns of the mark M are possible, and since patterns are printed in four columns, it is possible to form 256 types of codes (4×4×4×4). Fifty two (52) different playing cards are each assigned to one of the 256 codes, and the associations of such assignments are stored in a memory 12M or by a program as an association table. The cord reading unit 8 can, by identifying the code C, identify the number (rank) and the type (suit) of the card 1 based on that predetermined association tables (T1 to T10). Also, 52 cards can be freely associated with 52 codes out of the 256 codes to be stored in the association tables (T1 to T10), and thus, there will be a plurality of associations between them.

An association table is prepared by freely associating 52 codes out of the 256 codes with 52 cards, and a plurality of different association tables (T1 to T10) (in this Embodiment, 10 types) are prepared in advance. These ten types of association tables, databases, or programs are stored in advance in a memory 12M. When a game is started, firstly, the shuffled card ID of the shuffled playing card set 1*s* that is housed in the card shoe apparatus 2 to be used is identified by reading the barcode 3 (as the ID code) with the barcode reader 100. Upon identifying the shuffled playing card set to be used, the set of codes printed on these shuffled playing cards to be used is also identified based on that shuffled card ID. For example, numbers from 1 to 10 are assigned to plurality of association tables (T1 to T10) or databases, and the shuffled card ID of the shuffled playing cards to be used is subjected to process of association so as to be capable of identifying one of the association table numbers (T1 to T10) or database numbers. In this way, one of the ten types of the association tables (T1 to T10) or databases, each of which enables the correlation between the codes and the ranks of the cards to be obtained, is identified (for example, T3). The rank and the suit of the card 1 attached thereto are identified based on the code C with the use of the identified association table (T3). If the code C does not match the code defined in the association table (T3), an error occurs and it is determined that cheating may be committed.

Since one of the association tables (T1 to T10) or databases 1 to 10 is automatically identified based on the shuffled card ID within the card shoe apparatus 2, it is difficult to predict from the outside which of the ten types of association tables (T1 to T10) will be selected and used, and thus, it is possible to prevent the use of counterfeit cards or the like. In addition, the shuffled card ID read from the barcode 3 (as the ID code) is provided with information capable of identifying a certain group code SC. The control unit 12 is programmed such that it determines whether the group code SC identified by the shuffled card ID matches the group code SC printed on the shuffled playing cards to be actually used.

The control unit 12 will be described in further detail. The control unit 12 is achieved by a computer apparatus, and includes the winner/loser determination unit 10 that automatically determines the winner/loser of a game and the like. This process function (in the control unit 12) is achieved by installing in a computer a program for determining the winner/loser, which is executed by a computer processor. Also, the control unit 12 reads from the barcode 3 read by the barcode reader 100 the shuffled card ID, which can uniquely identify the shuffled playing card set 1*s*, and stores the shuffled card ID in the reading memory 12M. The control unit 12 reads the barcode 3 with the barcode reader 100, and stores the uniquely identifiable shuffled card ID. Then, the control unit 12 identifies the shuffled playing card set 1*s* that is currently to be used or to be used or being used in the game and the current time, and stores them in association with the shuffled card ID. In addition, the group code SC stored in association with the shuffled card ID is identified (stored in the memory 12M or the memory of an external control device (not shown)).

The code reading unit 8 reads the group code SC printed on the card 1 and the control unit 12 examines whether the group code SC read and the group code SC identified based on the shuffled card ID match. If the group code SC identified and the group code SC read by the code reading unit 8 do not match, such situation is considered an occurrence of an item that requires a security warning or the like, and a warning or the like is given by an external transmission apparatus 300 with the relevant shuffled card ID. Notice of the occurrence of an event that requires a security warning and the time (by a timer 2*t*) of its occurrence is given to the management division or the pit of the casino via the external transmission apparatus 300 in association with the relevant shuffled card ID. Also, if the code C, which is read by the code reading unit 8 and which represents a rank, does not match a code C that represents a rank defined in the association table (for example, T3), which is identified by the shuffled card ID read by the barcode reader 100, the control unit 12 externally sends such mismatch by the external transmission apparatus 300 with the relevant shuffled card ID.

In this manner, if it is determined with the use of the identified association table (T3) that the code C, which is read by the code reading unit 8 and which represents the rank, does not match a code defined in the identified association table, it is considered an occurrence of an error (irregular event), and notice of the occurrence of an event that requires a security warning and the time of its occurrence (by the timer 2*t*) is given to the management division or the pit of the casino in association with the relevant shuffled card ID. The management division of the casino stores and registers such transmitted items in association with the relevant shuffled card IDs in a database 400. The dealer or the like is also informed of the occurrence of a security item that requires a warning (mismatch of the group codes SC, irregularity in reading of a code C, or the like) by the display made by lamps 51 and a liquid crystal display unit 52.

In case of the occurrence of an item that requires a security warning or the like, a warning or the like is given by the external transmission apparatus 300 with the relevant shuffled card ID so that a report thereof is made to the management division or the pit of the casino via the external transmission apparatus 300 in association with the relevant shuffled card ID; however, the group code SC identified by the shuffled card ID of the shuffled playing card set 1*s* currently in use and the association table currently in use may be notified to the management division or the pit of the casino.

The group code SC will be described in further detail. As shown in FIG. 4, the card 1 is provided with a group code SC that is configured by encoding information that represents the group of the card and is invisible under normal conditions (for example, UV ink). This group code SC is provided in the same position in at least the cards of the same set. The group code SC is a substance or material itself that emits, as a code, light rays of different wavelength spectra when irradiated with light rays of different wavelengths, and is configured such that light rays of different wavelengths are emitted when irradiated with light rays of different wavelengths. Whether the group code SC identified and the group code SC read by the code reading unit 8 match or not is determined by the control unit 12, depending on whether or not the predetermined wavelength of light ray and that of the read group code SC match. At the start of the game, the shuffled card ID of the shuffled playing card set 1*s* that is housed in the card shoe apparatus 2 to be used is identified by reading the barcode 3 (as the ID code) with the barcode reader 100. The shuffled card ID and the group code SC are associated with each other such that if the shuffled playing card set 1*s* to be used is identified, the group code SC attached to such shuffled playing card set 1*s* is identified based on the shuffled card ID. Whether or not the group code SC identified by the control unit 12 of the card shoe apparatus 2 matches the group code SC read by the code reading unit 8 is determined when the group code SC attached to the card 1 used is actually read. Thus, it is impossible to know how the group code SC is determined from the outside.

A polymer material, DNA material or the like that has a molecular structure with which a light ray of a specific wavelength is emitted against light is used as a substance or material that emits light rays of different wavelength spectra against invisible light rays of different wavelengths (ultraviolet ray, infrared ray, etc.). A polymer material that has a molecular structure with which a light ray of a specific wavelength is emitted against light is printed in the upper and lower edges of the card 1 as shown in FIG. 4, as the group code SC. The group code SC cannot be recognized by human eyes under normal use conditions (daylight, natural light, or the like). The group code SC is read by the UV sensor 24. The group code SC is read by the UV sensor 24 provided in the card guide 7 when the card 1 is guided by the card guide unit 7 as it is slid through it. Also, the group code SC may be mixed with an infrared or ultraviolet responsive ink for printing the code C, which is used for identifying the number (rank) of the card 1, as printed. Each group code SC within the infrared or ultraviolet responsive ink cannot be recognized by human eyes under normal use conditions (daylight, natural light, or the like). The light source for reading the group code SC is integrally provided with the UV sensor 24. In Embodiment 1, LEDs that emit ultraviolet rays of two different wavelengths (UV LEDs) are used as sources of light (not shown).

The group code SC is printed independently and in the same position at least for the same set, as described above. However, a configuration is also possible in which the group code SC is configured using a certain substance or material that serves as a code, and such substance or material is contained in the coating material, anchor coating material, or in the ink to print the back pattern, mark, index, or the code to indicate the number of the mark on the surface of the card. As a variation of the present embodiments, the group code may be printed on the card 1 in a similar manner to that of the mark M or the barcode 3. The group information, which indicates the group of the group code, may be different for each deck or for each plurality of decks of cards 1. The group information may be differentiated for each casino or table where the cards are used, or for any other unit. The group information may be different for each card supply source (card shoe or the like). In addition, a different group code may be set for each manufacturing lot, or each casino that uses the cards.

Next, a variation in which an input means 200 is provided instead of the barcode reader 100 that is capable of identifying the shuffled card ID will be described. Instead of reading the barcode 3 with the barcode reader 100 to identify the shuffled card ID of the card set to be used, a configuration is possible in which a barcode reader is provided in a separate device installed on the game table (for example, an apparatus for the disposal of the card 1 or a device that confirms the card 1 disposed), and the shuffled card ID of the card set to be used is obtained by such a barcode reader, and the shuffled card ID is input to the card shoe apparatus 2 through communication 201 with such a device. In this case, the separate device with the barcode reader serves as an input apparatus capable of identifying the shuffled card ID.

REFERENCE SIGNS LIST

1 card
1*s* shuffled playing card set
2 card shoe apparatus
2C card housing unit
3 barcode
8 code reading unit
10 winner/loser determination unit
12 control unit
13 opening
100 barcode reader

The invention claimed is:

1. A table game system comprising:

a shuffled playing card set composed of playing cards from a plurality of decks shuffled to have a unique arrangement order, a uniquely identifiable shuffled card ID being attached to the shuffled playing card set; and a card shoe apparatus that includes a barcode reader capable of identifying the shuffled card ID, the card shoe apparatus being configured to house the shuffled playing card set such that the playing cards can be dealt one by one onto a game table, wherein each one of the playing cards includes a code that identifies a rank of the card, wherein the card shoe apparatus comprises:

a card housing unit for housing the shuffled playing card set;

an opening for drawing the playing cards from the card housing unit one by one;

a code reading unit that reads the code attached to each drawn playing card identifying the rank of the drawn playing card; and a control unit that stores rules of a card game and includes a winner/loser determination unit that determines the winner/loser of the card game based on the code identifying the ranks of the drawn playing cards read by the code reading unit, wherein the control unit includes a memory for storing a plurality of association tables, each of the plurality of association tables associating the code included on each playing card with the rank of the playing card;

wherein the code included on each playing card in the shuffled card set is attached using a specific association table selected from the plurality of association tables stored in memory, wherein the shuffled card ID attached to the shuffled card set contains information for identifying the specific association table; and wherein the code reading unit is configured to determine whether the code on each of the drawn playing cards in the shuffled card set matches a rank for each drawn playing card defined in the specific association table.

2. The table game system according to claim 1, wherein a group code is included on each card of the shuffled playing card set, the shuffled card ID is associated with the group code, the code reading unit is configured to read the group code included on the card, and the control unit is configured to determine whether the read group code matches a group code associated with the shuffled card ID.

3. The table game system according to claim 1, further comprising an input means for information that identifies the shuffled card ID, wherein the shuffled card ID is obtained by a communication means via the input means.

4. A table game system comprising:

a shuffled playing card set composed of playing cards from a plurality of decks shuffled to have a unique arrangement order, a uniquely identifiable shuffled card ID being attached to the shuffled playing card set; and a card shoe apparatus that includes a reader capable of identifying the shuffled card ID, the card shoe apparatus being configured to house the shuffled playing card set such that the playing cards can be dealt one by one onto a game table, wherein a group code is printed on each of the playing cards, and the shuffled card ID is associated with the group code, wherein the card shoe apparatus comprises:

a card housing unit for housing the shuffled playing card set;

an opening for drawing playing cards from the card housing unit one by one;

a code reading unit that reads from each drawn playing card information attached to the playing card concerning the rank thereof; and a control unit that stores rules of a card game and includes a winner/loser determination unit that determines the winner/loser of the card game based on the information concerning the ranks of the cards read by the code reading unit, and wherein the code reading unit is configured to read the group code attached to each playing card, and wherein the control unit is configured to determine whether the read group code matches a group code identified based on the shuffled card ID.

5. The table game system according to claim 4, wherein each playing card of the shuffled playing card set includes a code identifying the rank of the card, wherein the control unit includes a memory configured to store a plurality of association tables or a plurality of databases, each of which associates the rank of each card in the shuffled playing card set with the code included on the playing card; and wherein the shuffled card ID is associated with a specific association table or database selected from the plurality of association tables or databases;

wherein the card shoe apparatus further comprises a reader configured to identify the shuffled card ID, and based on the association table or database identified, the code reading unit is configured to read the code when each playing card is drawn from the card housing unit and the control unit is configured to identify the rank of the card based on the code and to determine whether the code on each of the playing cards in the shuffled card set matches a rank for each playing card defined in the specific association table.

6. The table game system according to claim 5 further comprising a transmission apparatus configured to externally transmit a mismatch along with the shuffled card ID if the group code read by the code reading unit or the code identifying the rank does not match the group code identified based on the shuffled card ID read by the reader or a code that is defined in the specific association table and that represents a rank.

* * * * *